US008869409B2

(12) United States Patent
Blum

(10) Patent No.: US 8,869,409 B2
(45) Date of Patent: Oct. 28, 2014

(54) HAND PLANE WITH REVERSE ANGLE FROG

(76) Inventor: Gary Joseph Blum, Walnut, IA (US)

( * ) Notice: Subject to any disclaimer, the term of this patent is extended or adjusted under 35 U.S.C. 154(b) by 1788 days.

(21) Appl. No.: 11/469,497

(22) Filed: Sep. 1, 2006

(65) Prior Publication Data

US 2008/0052924 A1 Mar. 6, 2008

(51) Int. Cl.
*B27G 17/02* (2006.01)

(52) U.S. Cl.
CPC ..... *B27G 17/02* (2013.01)
USPC ..... 30/478; 30/485

(58) Field of Classification Search
USPC ..... 30/478, 479, 480, 481, 482, 484, 486, 30/487, 489, 490, 491, 492, 493
See application file for complete search history.

(56) References Cited

U.S. PATENT DOCUMENTS

| | | | | |
|---|---|---|---|---|
| 453,524 | A | 6/1891 | Tuoti | |
| 1,149,703 | A | 8/1915 | Vaughan | |
| 1,157,594 | A | 10/1915 | Selleck | |
| 1,417,857 | A * | 5/1922 | Pfeiffer | 30/487 |
| 1,507,722 | A | 9/1924 | Ahlen | |
| 1,559,797 | A | 11/1925 | Slomer | |
| 1,776,661 | A * | 9/1930 | McCue | 30/488 |
| 3,028,892 | A * | 4/1962 | Filia | 30/487 |
| 4,015,649 | A * | 4/1977 | Gilbert | 30/487 |
| 4,589,209 | A | 5/1986 | Zarges | |
| 5,694,696 | A * | 12/1997 | Lee et al. | 30/488 |
| 7,444,750 | B2 * | 11/2008 | Saunders | 30/488 |
| 2004/0074098 | A1 * | 4/2004 | Schwarz et al. | 30/169 |
| 2005/0060897 | A1 * | 3/2005 | Saunders | 30/478 |
| 2005/0188553 | A1 | 9/2005 | Lee et al. | |

* cited by examiner

*Primary Examiner* — Robert Scruggs
(74) *Attorney, Agent, or Firm* — McKee, Voorhees & Sease

(57) ABSTRACT

The improved hand plane of the present invention is used for planing wood, and includes interchangeable frog and blade assemblies. The plane includes a base with a sole and a throat, and a rear handle on the base adjacent the rear end. The frog is mounted in the base and extends upwardly and forwardly from the throat in a reverse angle so as to avoid interference with the handle. A blade is mounted to the frog with attachment screws accessible through the mouth of the throat in the sole of the plane. A pair of screws allows for depth and lateral positioning of the blade.

20 Claims, 9 Drawing Sheets

HAND PLANE WITH REVERSE ANGLE FROG

BACKGROUND OF THE INVENTION

Hand planes have been used for hundreds of years to smooth the surface of wood. A hand plane works when a woodworker pushes or pulls the plane across the surface of the wood which allows the sharp blade or iron to shear off a thin layer of wood, thereby smoothing the wood surface.

FIG. 1 shows an exploded view of a prior art metal hand plane. The hand plane assembly 10 has a base 12, with a bottom surface or sole 14. The base 12 has an opening in the sole 14 which is called the throat 16. Attached to the base 12 is a rear handle or tote 18 and a front knob 19. A device called a frog 20 extends upward from the inside of the base 12. The frog 20 extends rearwardly from the throat 16 towards the tote 18, and holds the cutting blade, which is known as the iron 28. The user can turn the depth adjuster 22 which allows the iron 28 to extend farther through the throat 16. Adjustment of the iron 28 depth allows the iron 28 to engage a deeper or shallower cut in the wood being planed. The lateral adjuster 24 allows the user to adjust the iron 28 into a left or right position. This in turn, allows for deeper cuts on one side of the plane or the other. A bolt inserted near the center of the frog 20 is called the fulcrum stud 26. This stud 26 allows the iron 28 to be fastened securely to the frog 20, so as to make a secure, tight fit which holds the iron 28 in place during use.

In order for the iron 28 to be of use, it must be sharpened. The sharpened area on an iron 28 is called the bevel 29. Most prior art hand planes are designed in one of two ways. They either have the iron bevel up or bevel down in relation to the sole 14 of the plane. Typically planes that have a down bevel are similar to the design shown in the hand plane assembly 10. On the other hand, common bevel up irons are used in a different style of hand plane (not shown) which do not have the frog. Instead, the iron 28 lays on an inclined surface on the inside of the base 12 without the aid of the frog 20. This allows a bevel up iron 28 to lie at a much more reclined angle inside the base 12 of the plane, for use on wood with more difficult grain.

A cap iron 30 is used in conjunction with the iron 28 on bevel down type planes. The cap iron 30 is secured to the iron 28 by the use of a cap iron screw 36. This cap iron 30 acts has a lower chip breaker 38 which helps to curl the wood shavings cut by the iron 28 before they have a chance to split or tear away from the larger working piece of wood being planed. Overall, the chip breaker 38 contributes for much smoother cutting on the work surface of the wood. The iron 28 and the cap iron 30 when bolted together by the use of the cap iron screw 36 become one piece, which is held onto the frog 20 by the use of the lever cap 32. This lever cap has a lever 34 with a cam on the end which applies pressure against the cap iron 30 to hold the cap iron 30 and the iron 28 assembly in place on top of the frog 20. The cam on the bottom of the lever 34 causes the lever cap 32 to pivot around the fulcrum stud 26 and remain tight on the cap iron 30 and iron 28 assembly.

One of the primary problems with the conventional metal plane 10 is the ergonomics of the user's handgrip on the tote 18. The rearward angle and extension of the iron 28 into close proximity with the tote 18 interferes with the handgrip, particularly for people with large hands. Also, the large, cutting iron is difficult to grind and hone. The thin iron 28 is also subject to flex, because of the hollow ground bevel 29 and due to bedding of the iron 28 to the frog 20. Also, on smooth planes such as shown in FIG. 1, the physical space required for the inclined iron 28 and the rear tote 18 is approximately 7-10 inches, which leaves a relatively small amount of sole 14 in front of the iron 28 for registration on the wood, which decreases the accuracy of the planing process. Furthermore, the heel of the iron 28 must seat against the moveable frog 20, which moves the bedding of the iron 28 against the frog 20 up from the point of the heel, thereby decreasing the solidity of the bedding and resulting in chatter of the iron 28.

Another problem with this type prior art plane is that the pressure from the lever cap 32 or the clamping lever assembly 40 is applied to the cap iron behind the cutting edge of the iron 28. This allows the cutting edge of the iron 28 to vibrate and contributes to rough cuts. This creates opportunities for vibration and flex of the iron 28. This leads to chatter in thin cuts as the iron 28 loads and depends on the user to maintain a rigorous and forceful motion to keep the iron loaded during use. Every cutting edge, whether in wood or metal, needs a load (or bite) to work properly. With hand planes, the load occurs when the cutting edge first encounters the material to be cut. The edge of the blade or iron 28 deflects slightly and as long as there is significant forward motion of the plane, the iron 28 remains loaded and cuts the material.

FIG. 2 is a perspective view of a prior art wood block plane 40. The plane 40 includes a base 42 with a bottom sole 44 and a throat 46. A rear tote or handle 48 is attached to the top of the base 42. An elongated iron 50 is attached to a chip breaker 52 with a thumb screw or bolt (not shown). The iron 50 is retained in the throat 46 by a wedge 56. The iron 50 extends upwardly and rearwardly in close proximity to the tote 48, as seen in FIG. 2.

The wooden plane 40 also has problems due to the construction and arrangement of the throat 46 and iron 50. The typical 45°-50° angle of the iron 50 and the corresponding vertical or reverse angle of the throat 46 causes wear at the mouth of the throat, as the sole 44 wears away during use or is made true again, thereby progressively increasing the width of the throat opening. Also, the iron 50 must bed against the inclined throat opening cut into the wood block base 42. Since the wood is subject to warping, the iron may not seat properly. While the large iron 50 and the cap iron 52 provide rigidity, these elements are difficult to remove or adjust. Typically, the iron is hit with the hammer for both depth and lateral adjustment, which is far from accurate. Backing out or loosening of the iron 50 is normally accomplished by wrapping the base 42 either at the rear or on the top surface towards the front of the stock, which presents difficulties. Furthermore, due to the large size of the iron 50 and its 45°-50° angle, the top of iron 50 projects upwardly through the base stock 42 and interferes with the normal hand grip position on the tote 48. Some smooth planes dispense with the rear tote 48 or are configured as a horn plane smoother, as is common in European wooden planes. Most wooden planes 40 also use either a thick tapered iron 50 or a relatively thick straight iron. When the iron 50 is ground at a 25° angle for the bevel, the length of the ground bevel is relatively long. Therefore, the point from where the iron is bedded against the wood body at the heel of the iron, and actual cutting edge, is relatively long, thereby subjecting the cutting edge to flex and chatter when encountering obstinate grain. This problem is exacerbated when the bevel is hollow ground on small radius grinding wheels, as is common.

Accordingly, a primary objective of the present invention is the provision of an improved hand plane for planing wood.

Another objective of the present invention is the provision of a hand plane having a reverse angle frog.

A further objective of the present invention is the provision of a hand plane having interchangeable frogs.

A further objective of the present invention is the provision of a hand plane having a first frog for smooth planing and a second frog for scraper planing.

Still another objective of the present invention is the provision of a hand plane that functions as a chip breaker without having a separate chip breaking component.

Another objective of the present invention is the provision of a hand plane having cutting blades that are disposable or resharpenable.

Yet another objective of the present invention is the provision of an improved hand plane having a single means for both depth and lateral adjustment of the cutting blade.

A further objective of the present invention is the provision of a hand plane having a frog which is moveable fore and aft without the use of tools.

Yet another objective of the present invention is the provision of a hand plane having a solidly seated blade.

Still another objective of the present invention is the provision of a hand plane having a throat with a mouth that does not widen as the sole is worn down or trued.

A further objective of the present invention is the provision of an improved hand plane having a rear tote which can be gripped without interference.

Another objective of the present invention is the provision of an improved hand plane which is economical to manufacture, yet durable and effective in use.

These and other objectives will become apparent from the following description of the invention.

SUMMARY OF THE INVENTION

The hand plane of the present invention includes a base with a sole and a throat, and opposite front and rear ends. A rear handle is provided on the base adjacent the rear end, and a front knob is provided on the base adjacent the forward end. A reverse angle frog is mounted in the base and extends upwardly and forwardly from the throat. A blade is mounted on the frog for planing wood. The blade may be a cutting blade or a scraping blade. Interchangeable frogs are provided for varying angle of attack, and for changing from a smoothing frog to a scraping frog. The reverse angle of the frog avoids interference for a person's hand gripping the rear tote. The blades may be disposable or resharpenable. On the smoothing frog, the blade is sandwiched between the frog and a backup iron. A pair of screws provides for both depth and lateral adjustment of the blade.

DETAILED DESCRIPTION OF THE PREFERRED EMBODIMENT

Figure 1:
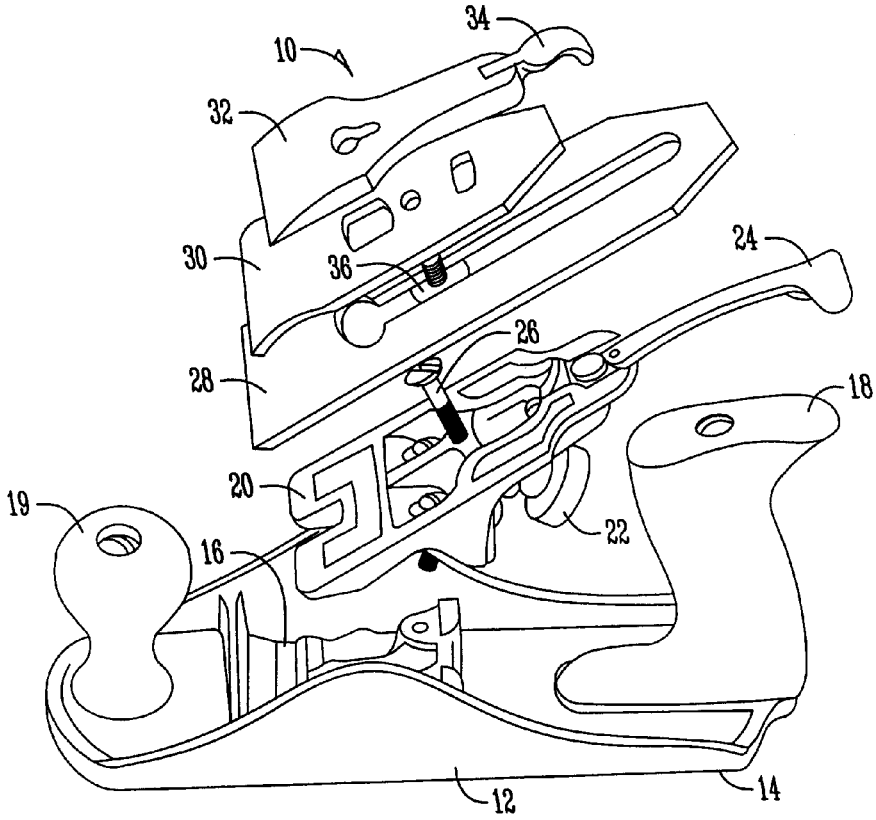
FIG 1 (PRIOR ART)
FIG. 1 is an exploded view of the components of a prior art metal plane.
Figure 1A:
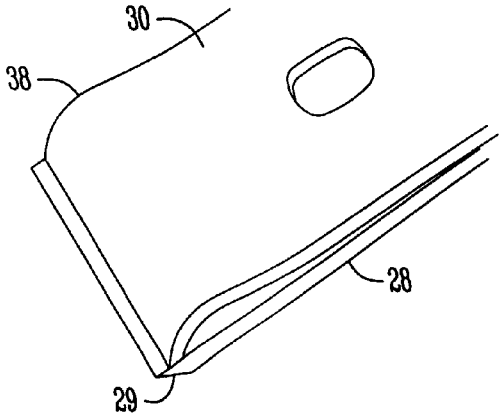
FIG 1A (PRIOR ART)
FIG. 1A is an enlarged perspective view of the cutting blade and cap iron of the plane shown in FIG. 1.
Figure 2:
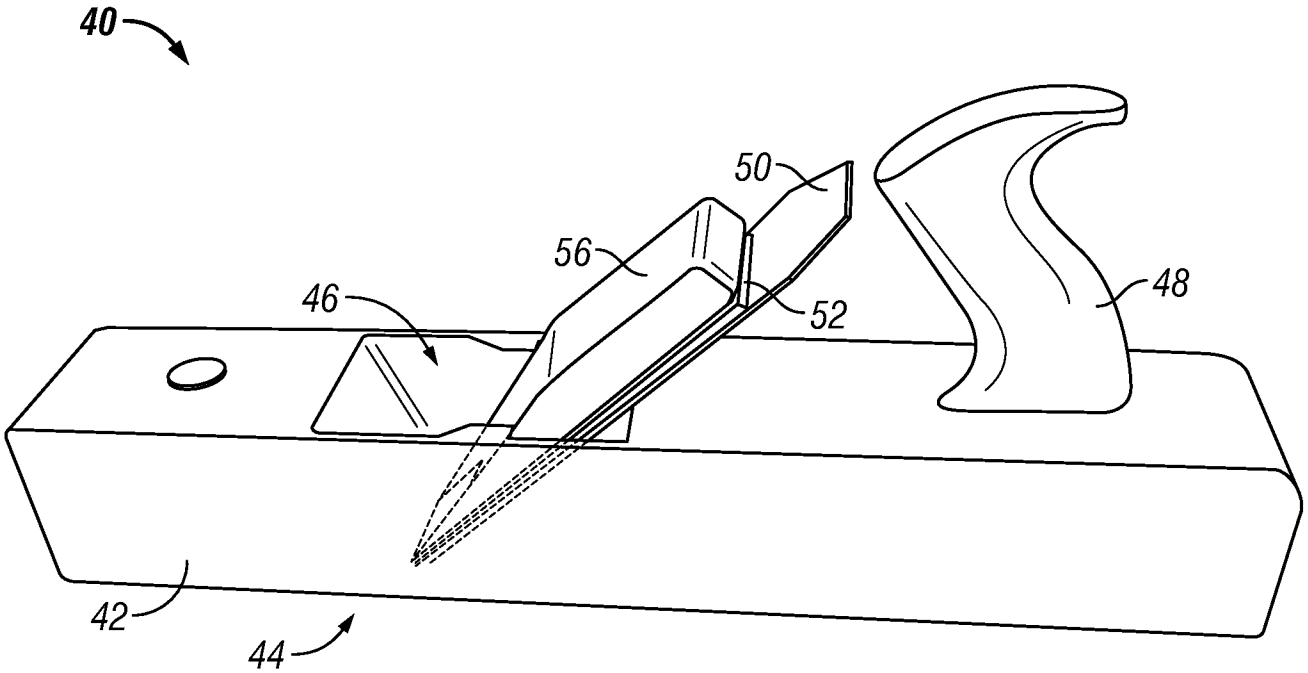
FIG. 2 (Prior Art)
FIG. 2 is a perspective view of a prior art wood block plane.
Figure 3:
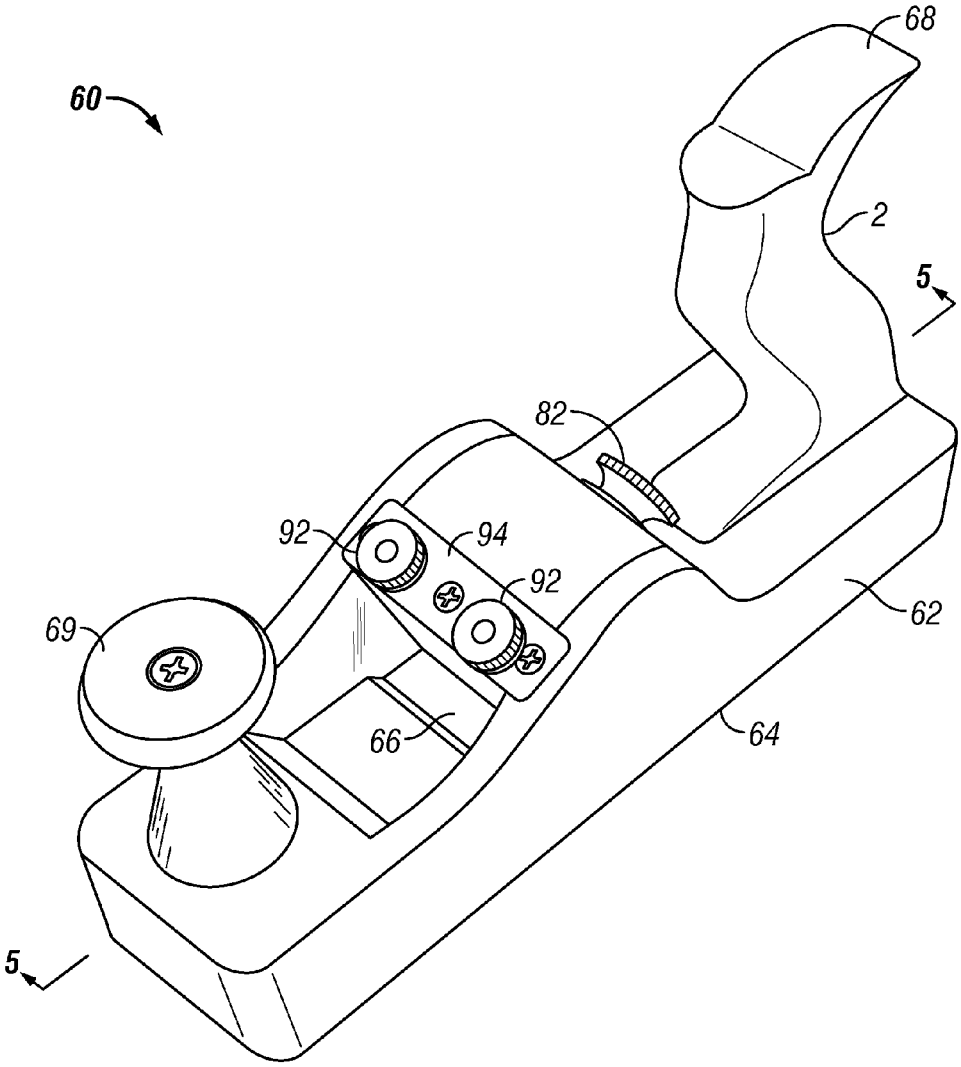
FIG. 3 is a perspective view of the improved hand plane of the present invention.

One embodiment of the improved hand plane of the present invention is shown in FIGS. 3-6. The improved hand plane 60 includes a base 62 with a bottom surface or sole 64 and a throat 66 which extends through the base 62 so as to define a mouth 67 on the sole 64. A rear tote or handle 68 is provided adjacent a rearward end of the plane 60, while a front handle or knob 69 is provided adjacent the front end of the plane 60.

Figure 5:
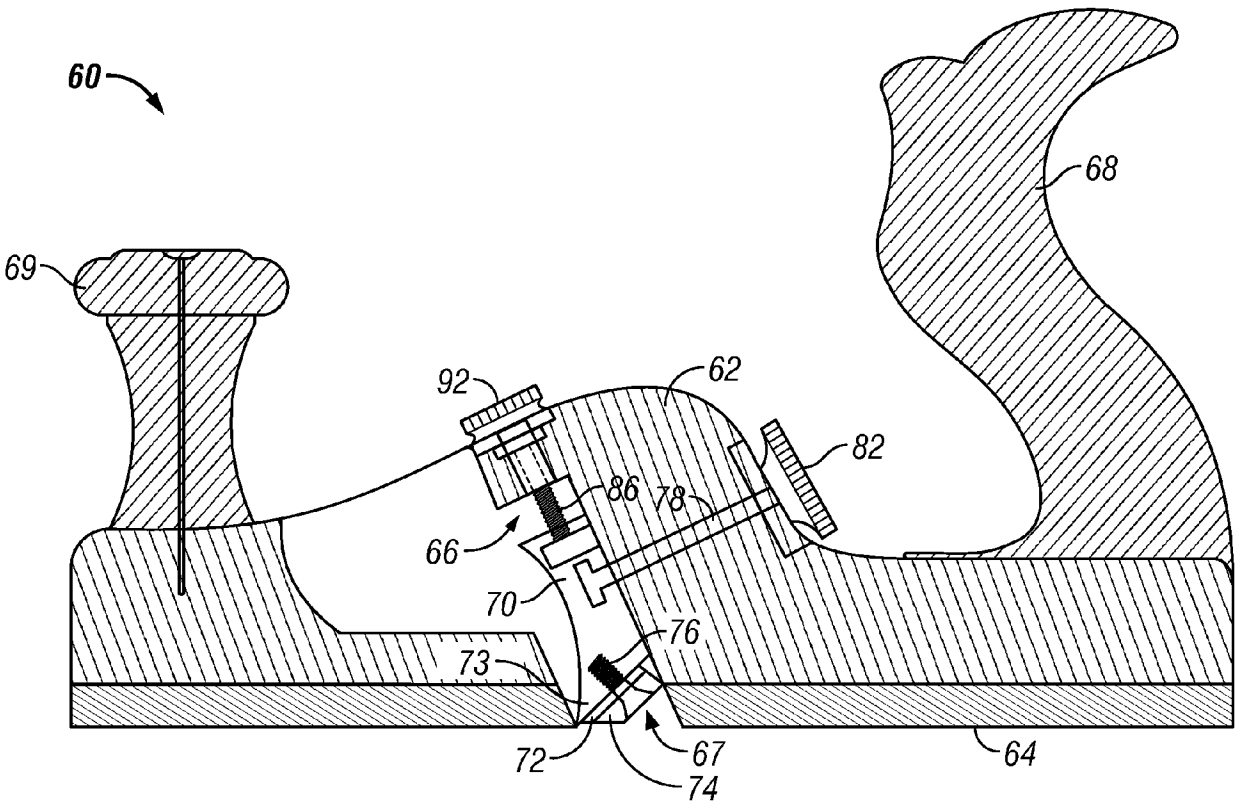
FIG. 5 is a sectional view of the plane taken along lines 5-5 of FIG. 3.
Figure 6:
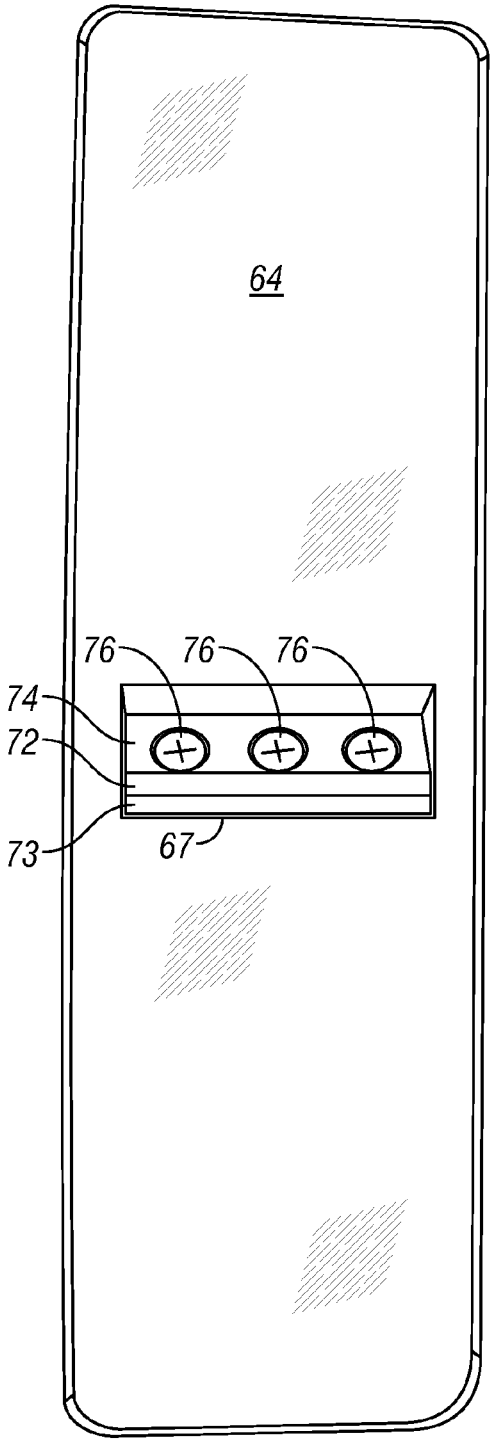
FIG. 6 is a bottom plan view of the plane.

A frog 70 is mounted in the throat 66 in a reverse angle, as compared to the prior art frog 20 shown in FIG. 1. The frog 70 extends upwardly and forwardly, as best seen in FIG. 5. A cutting blade or iron 72 is mounted on the bottom of the frog 70, and sandwiched between the frog 70 and a backup iron 74. A plurality of screws 76 extend through holes in the backup iron 74 and through slots in the blade 72 for threaded receipt in the bottom of the frog 70. Thus, when it is time t0 sharpen or dispose of the blade 72, the screw 76 need only be loosened slightly so that the blade can be slid out from between the frog 70 and the back iron 74.

Figure 4:
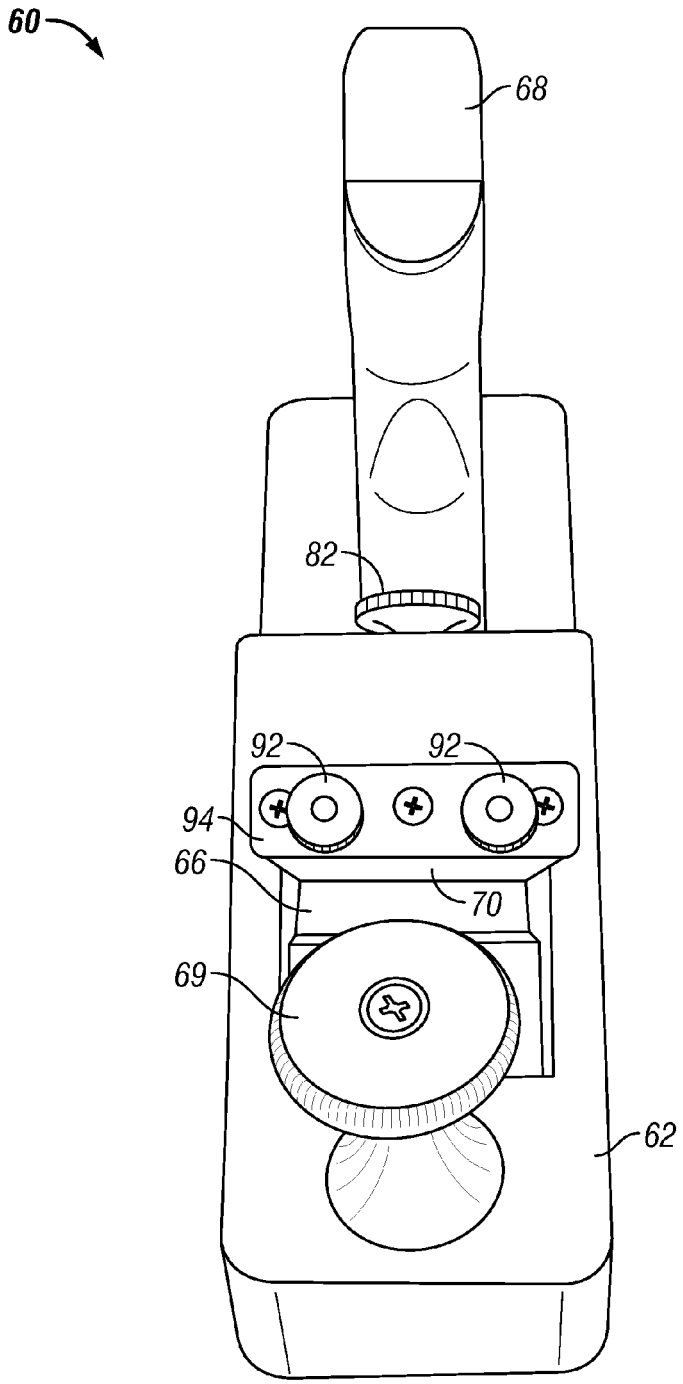
FIG. 4 is another perspective view from the front of the plane of the present invention.

The frog 70 is mounted in the throat 66 by a lock bolt 78 extending through the base 62, as best seen in FIG. 5. The rear face of the frog 70 includes a keyed slot 80 adapted to receive a head on the forward end of the lock bolt 78. The rear end of the lock bolt 78 includes a kipp-type locking lever 82 for tightening the lock bolt 78 such that the frog 70 is solidly seated against the back wall of the throat 66. Two throat adjusting screws 84 also extend through the base 62, as seen in FIGS. 4 and 5. Screws 84 are adjusted by hand and provide a solid seating against the back of the frog 7. In so doing the frog 70 can be moved fore and aft to close or open the mouth opening 67. The lock bolt 78 and the screws 84 provide a 3-point bearing for the frog 70.

A pair of threaded shafts 86 have a lower end with a dowel or head 88 received in keyed openings 90 in the frog 70, and an upper end extending upwardly through the base 62 with a knurled adjusting nut 92 which can be turned to adjust the depth and lateral position of the blade 72 relative to the mouth 67 of the throat 66. A metal plate 94 is provided on the upper surface of the base 62 beneath the knurled nuts 92, with a snap ring residing below the metal plate 94 on each of the shafts 86. Because the two adjusting screws or shafts 86 operate independently at the outer sides of the frog 70, adjustment of the depth of the blade 72 also adjusts the lateral position of the blade, thereby eliminating any separate lateral adjustment component. Thus, the positioning of the blade is a quick and precise process. The throat adjusting screws 84 can be turned by a user's finger and thumb, without the use of a tool, such as a screwdriver, as in the prior art. Turning of the screws 84 allows the frog 70 to be moved forwardly and rearwardly at the bottom so as to open and close the mouth 67 of the throat 66. Under normal planing conditions, the lock bolt 78 holds the frog 70 in position within the throat, but is not so tight as to preclude depth and lateral adjustment by the adjusting screws 86.

Figure 8:
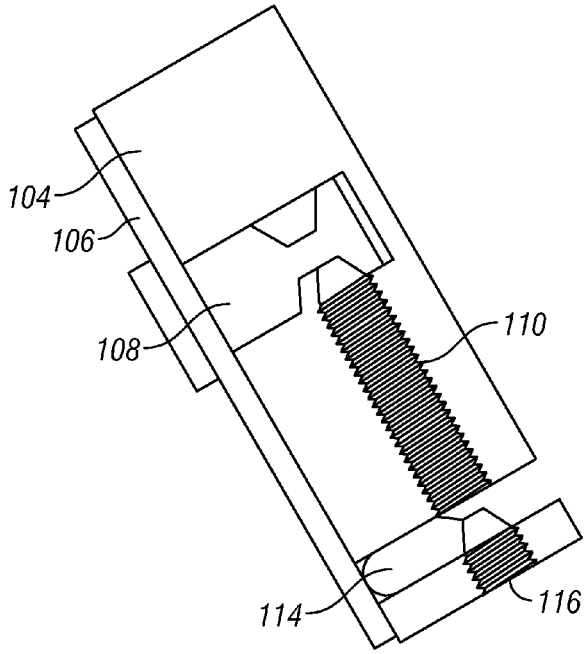
FIG. 8 is a side view of one of the frog shafts.

As seen in FIG. 8, the head 88 of each shaft 86 includes a keyway-type slot 89. A pin 91 pivotally mounts the shaft 86 to the head 88, so that the frog 70 can pivot fore and aft at the bottom to narrow and widen the mouth opening 67.

Figure 9:
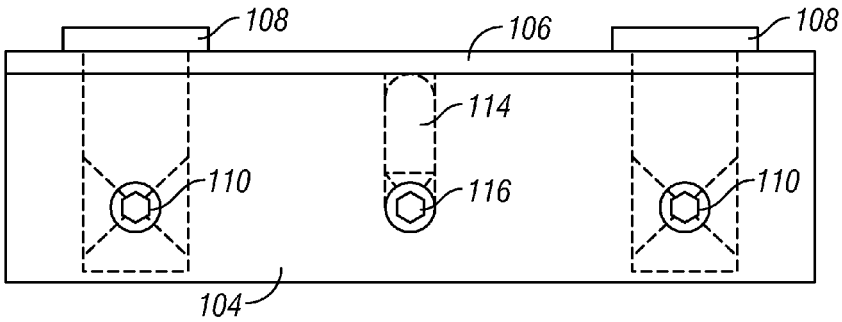
FIG. 9 is an exploded view of the lock bolt assembly for the frog.

FIG. 9 shows an exploded view of the lock bolt assembly. The bolt 78 includes a head 120 at its lower end and external threads 122 at its upper end. The upper end of the bolt 78 also includes a threaded bore 124. A locking nut 126 is received on the threads 122 of the bolt 78, and is received in a mating recess 83 in the locking lever 82. A shoulder screw 128 extends through the locking lever 82 and has a threaded lower end 130 for receipt in the threaded bore 124 of the bolt 78. A spring 132 on the screw 128 applies sufficient force so as to prevent the screw 128 from unintentionally becoming unthreaded from the bolt 78.

In use, the depth and lateral position of the blade 72 of the hand plane 60 is adjusted by the knurled nuts 92, which move the frog 70 upwardly and downwardly within the throat 66. The reverse angle of the frog 70 causes the frog to act as chip breaker for the blade or iron 72 as the blade cuts shavings from the wood being smoothed. The curved or concave front face 98 of the frog 70 directs the shavings up and out of the throat 66. The bottom surface 100 of the frog 70 is ground at an angle that will place the blade 72 at the desired angle for the primary work of the plane 60. This angle may be from 20°-60° in relation to the sole 64 of the plane 60. The frog 70 may be seated 95°-120° in relation of the sole 64. Because of the reverse angle of the frog 70, and a corresponding angle at the front of the mouth 67, when the sole 64 wears or is reduced by truing, the mouth 67 will stay constant for the life of the sole 64. The reverse angle of the frog 70 also provides the benefit of allowing the rear handle or tote 68 to be gripped in a more ergonomically proper manner, without interference from the frog 70 or the blade 72.

The blade 72 is disposable or resharpenable. The rigid backup iron 74 prevents flexing of the blade 72. The backup iron 74 is ground so as to have a minimum clearance angle and therefore maximum support for the thin blade 72. The bevel 73 of the blade 72 is very short due to the thin profile of the blade, and therefore the cantilever of the unsupported portion of the blade 72 is very short. The assembly of the frog 70, the blade 72, and the backup iron 74 provides for rigidity for the blade 72, thereby reducing chatter and flex so that the plane 60 will more easily cut obstinate grain with reduced tear-out.

Figure 7:
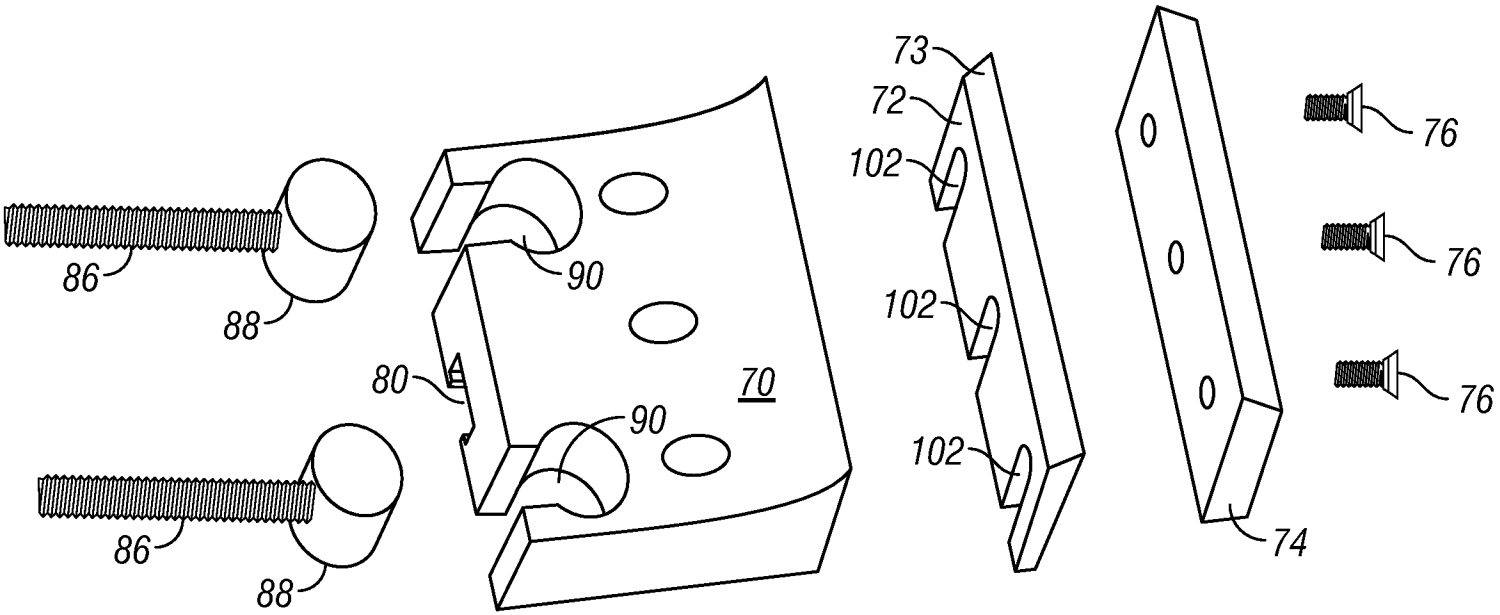
FIG. 7 is an exploded perspective view of the frog assembly of the improved hand plane of the present invention.

The screws 76 which mount the blade 72 and backup iron 74 to the frog 70, are accessible through the mouth 67 in the sole 64 of the plane 60. In order to change or sharpen the blade 72, the frog 70 need only be lowered a small amount through the sole 64, and the screws 76, such that the blade 72 can be removed via the slots 102, as best shown in FIG. 7. If the blade 72 is disposable, it may be double sided, with holes, rather than slots, for the fixing screws 76, which then need to be fully removed to replace the disposable blade.

Figure 10:
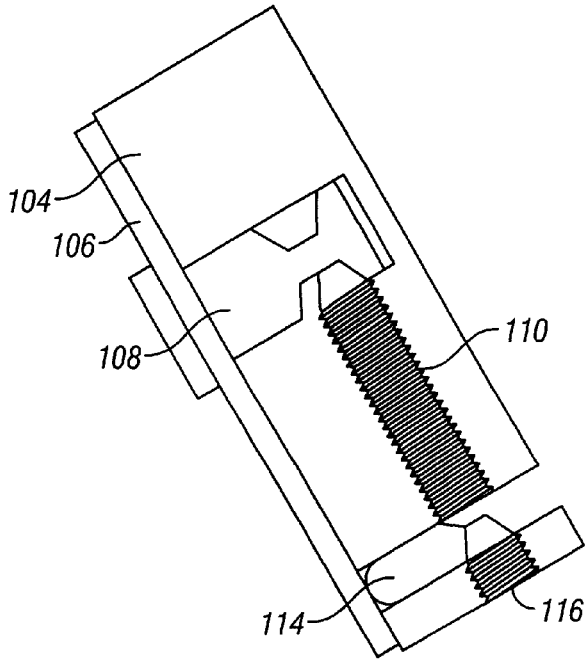
FIG. 10 is a side elevation view of a scraping frog according to the present invention.
Figure 11:
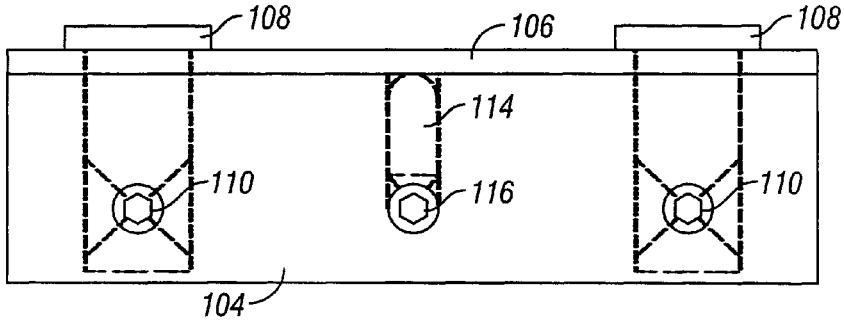
FIG. 11 is a bottom plan view of the scraping frog.

The assembly of the frog 70, blade 72, and backup iron 74 may be replaced with a second assembly, shown in FIGS. 10 and 11. The scraper assembly includes a frog 104 with a scraper blade 106 secured to the front face of the frog 104 by a lock bolt 108. The lock bolt 108 is retained by an elongated lock screw 110 accessible through the bottom of the frog 104. The frog also includes a rearwardly extending slot 112 to receive a bowing pin 114. The position of the bowing pin 114 is controlled by a bowing screw 116 accessible through the bottom of the frog 104. The pin 114 and screw 116 have tapered mating surfaces which allow the pin 114 to be advanced or retracted within the slot 112. When the screw 114 is threaded deeper into the slot 112, the pin 114 is forced forwardly slightly so as to engage the blade 106, and bow the blade a small degree. The lock screws 110 and the bowing screw 116 are accessible through the mouth 67 of the base 62. The pin 114 applies tension to the blade 106, and thereby keeps the corners of the blade from digging in during the scraping process. Thus, that the improved hand plane 60 of the present invention can be used for both smoothing wood and scraping wood, with interchangeable frog and blade assemblies to accommodate the different functions and different wood characteristics.

It is further understood that the first frog assembly 70, 72, 74 can be interchanged with yet another frog assembly having a different angle of attack. For example, one frog assembly may have an angle of attack of 40°-50°, while another frog assembly may have an angle of attack of 55°-60° to accommodate wild grain.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A hand plane for planing wood, comprising:
- a base with a sole and a throat, and opposite front and rear ends;
- a rear handle on the base adjacent the rear end;
- a frog secured to the base with a threaded member and having a longitudinal axis extending upwardly and forwardly from the throat;
- a cutting blade secured to the frog with at least one threaded fastener to cut the wood during planing; and
- a pair of screws extending through the base and into the frog to adjustably mount the frog to the base and thereby allow depth and lateral positioning of the blade.

2. The hand plane of claim 1 wherein the frog is adjustably mounted in the base for depth adjustment, lateral adjustment, and mouth adjustment.

3. The hand plane of claim 1 wherein the frog extends at an angle between 95°-120° relative to the sole.

4. The hand plane of claim 1 wherein the frog has a concave curved front surface so as to provide a chip breaker.

5. The hand plane of claim 1 wherein the blade is resharpenable.

6. The hand plane of claim 1 wherein the blade is disposable.

7. The hand plane of claim 1 further comprising a backup iron mounted to the frog so as to sandwich the blade between the frog and the backup iron.

8. The hand plane of claim 1 wherein the blade mounts on the bottom of the frog such that the plane is a smooth plane.

9. The hand plane of claim 1 wherein the blade mounts on the front of the frog so as to have a forwardly inclined longitudinal axis whereby the plane is converted to a scraper plane.

10. The hand plane of claim 9 wherein the base has an upper surface and the frog resides below the upper surface.

11. The hand plane of claim 10 wherein the base has an upper surface and the blade resides beneath the upper surface.

12. The hand plane of claim 1 wherein the blade has opposite front and rear edges defining a blade plane which is non-parallel to the frog longitudinal axis.

13. The hand plane of claim 1 wherein the blade has front and rear edges defining a blade plane which extends upwardly and rearwardly.

14. The hand plane of claim 1 wherein the longitudinal axis of the frog is parallel to the screws.

15. A hand plane for planning wood, comprising:
- a base having opposite front and rear ends and a bottom sole;
- a throat extending through the base and having a rear surface extending upwardly and forwardly;
- a frog adjustably mounted in the throat and engaging the upwardly and forwardly extending throat surface; and a blade adjustably mounted to the frog for cutting wood during planing.

16. The hand plane of claim 15 wherein multiple threaded fasteners extend through the base and into the frog to adjust and secure the frog in a selected position in the throat, with at least two of the fasteners being angularly disposed with respect to one another.

17. The hand plane of claim 15 wherein the frog is adjustably mounted in the base for depth adjustment and lateral adjustment.

18. The hand plane of claim 15 wherein the frog has a concave curved front surface so as to provide a chip breaker.

19. The hand plane of claim 15 further comprising a pair of screws extending through the base and into the frog to adjustably mount the frog to the base and thereby allow depth and lateral positioning of the blade.

20. The hand plane of claim 15 wherein the frog extends at a forward angle, from bottom to top, between 95°-120° relative to the sole.

* * * * *